US008648519B2

(12) United States Patent
Kishimoto et al.

(10) Patent No.: US 8,648,519 B2
(45) Date of Patent: Feb. 11, 2014

(54) SPARK PLUG FOR INTERNAL COMBUSTION ENGINE

(75) Inventors: Kaori Kishimoto, Aichi (JP); Yasushi Sakakura, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/998,301

(22) PCT Filed: Nov. 20, 2009

(86) PCT No.: PCT/JP2009/069695
§ 371 (c)(1),
(2), (4) Date: Apr. 6, 2011

(87) PCT Pub. No.: WO2010/058835
PCT Pub. Date: May 27, 2010

(65) Prior Publication Data

US 2011/0198981 A1 Aug. 18, 2011

(30) Foreign Application Priority Data

Nov. 21, 2008 (JP) ..... 2008-297478

(51) Int. Cl.
*H01T 13/20* (2006.01)

(52) U.S. Cl.
USPC ..... 313/141; 313/118

(58) Field of Classification Search
USPC ..... 313/118–145; 123/32, 41, 143 R, 123/146.5 R, 169 P, 260, 280, 169 R, 169 EL, 123/310
See application file for complete search history.

(56) References Cited

U.S. PATENT DOCUMENTS

| | | | | |
|---|---|---|---|---|
| 6,346,766 | B1 | 2/2002 | Kanao et al. | 313/141 |
| 6,621,198 | B2 | 9/2003 | Kanao et al. | 313/141 |
| 8,106,572 | B2 * | 1/2012 | Tanaka et al. | 313/141 |
| 2001/0013746 | A1 * | 8/2001 | Kanao et al. | 313/144 |
| 2003/0015951 | A1 | 1/2003 | Segawa et al. | 313/141 |
| 2006/0043855 | A1 | 3/2006 | Nunome et al. | 313/120 |
| 2008/0074025 | A1 * | 3/2008 | Hori | 313/141 |
| 2009/0289539 | A1 * | 11/2009 | Sakakura | 313/141 |

FOREIGN PATENT DOCUMENTS

| | | | |
|---|---|---|---|
| JP | 59-40482 | 3/1984 | H01T 13/32 |
| JP | 11-329668 | 11/1999 | H01T 13/39 |
| JP | 2001-273965 | 10/2001 | H01T 13/20 |
| JP | 2001-273966 | 10/2001 | H01T 13/39 |
| JP | 2004-288376 | 10/2004 | H01T 13/39 |
| JP | 2006-236906 | 9/2006 | H01T 13/20 |
| WO | WO 2004/107517 | 12/2004 | H01T 13/39 |

OTHER PUBLICATIONS

Form PCT/ISA/210—Int'l Search Report (from corresponding Int'l Patent App. No. PCT/JP2009/069695—English version only); 2 pages.
Article entitled: "Better than Gold: Double Platinum Spark Plugs Help Achieve 100,000 Mile Tune-up;" Automotive Accessories Connection; Jul. 25, 2008, 3 pages.
EPO Form 1507S, Supplementary European Search Report, dated Mar. 1, 2013; from corresponding European Paent App. No. 09827616.5; 8 pages.

* cited by examiner

*Primary Examiner* — Donald Raleigh
(74) *Attorney, Agent, or Firm* — Kusner & Jaffe

(57) ABSTRACT

A spark plug is provided with a ground electrode, a noble metal tip made of a Pt alloy, and a relieving layer tip made of a Pt alloy which has a linear expansion coefficient between that of the ground electrode and that of the noble metal tip.

10 Claims, 10 Drawing Sheets

SPARK PLUG FOR INTERNAL COMBUSTION ENGINE

FIELD OF THE INVENTION

The present invention relates to a spark plug used for an internal-combustion engine.

BACKGROUND OF THE INVENTION

A spark plug used for an internal-combustion engine, such as an automobile engine, is provided with a center electrode extending, for example, in an axis direction, an insulator disposed outside of the center electrode, a cylindrical metal shell disposed outside of the insulator, and a ground electrode having a base end that is joined to a front end portion of the metal shell. Further, the ground electrode is bent so that a front end portion thereof faces the front end portion of the center electrode. Furthermore, a noble metal tip is provided with the front end portion of the ground electrode in order to improve erosion resistance properties.

The noble metal tip is usually directly joined to the front end portion of the ground electrode by resistance welding. However, in this case, a stress difference is likely to increase due to difference in thermal expansion between a metal material constituting the ground electrode and a metal material constituting the noble metal tip. As a result, a crack is likely to occur in a joint portion between the ground electrode and the noble metal tip, and the noble metal tip is prone to be separated from the ground electrode.

Therefore, there is proposed a technique wherein a relieving layer tip is disposed between the ground electrode and the noble metal tip. The relieving layer tip is made of a metal material having a linear expansion coefficient between that of the metal material constituting the ground electrode and that of the metal material constituting the noble metal tip. See, for example, Japanese Patent Application Laid-Open (kokai) No. 2001-273966. According to this technique, the difference in thermal expansion is made relatively small between the ground electrode and the relieving layer tip, and between the relieving layer tip and the noble metal tip. Consequently, occurrence of the crack in the joint portion can be prevented.

SUMMARY OF THE INVENTION

However, in the above-mentioned conventional technique, since a noble metal tip and a relieving layer tip are joined by resistance welding, joint strength between the noble metal tip and the relieving layer tip cannot be fully obtained. In addition, if a minute crack occurs in a joint portion, oxygen might penetrate into the crack, whereby an oxidized scale may progress in the joint portion. Therefore, even if the conventional technique is adopted, there is still a possibility that the noble metal tip might be separated from the ground electrode.

The present invention has been accomplished in view of the above-mentioned problems. An advantage of the present invention is a spark plug for an internal-combustion engine, wherein the spark plug has a relieving layer tip between a noble metal tip and a ground electrode, and wherein the noble metal tip is securely joined to the ground electrode. A separation of the noble metal tip from the ground electrode is prevented by suppressing a progress of oxidized scale in a joint portion.

Configurations suitable for achieving the above-described advantages will be described in an itemized fashion. Notably, when necessary, effects peculiar to each configuration will be added.

In accordance with a first aspect of the present invention, there is provided a spark plug for use in an internal-combustion engine, comprising:

an insulator having an axial bore extending in an axial direction;

a rod-like center electrode disposed in the axial bore;

a cylindrical metal shell formed on an outer circumference of the insulator;

a ground electrode extending from a front end portion of the metal shell and bent towards the center electrode;

a plate-like relieving layer tip embedded in and joined to a front end portion of the ground electrode by resistance welding; and a noble metal tip having one end which is joined by resistance welding to a portion of the relieving layer tip on the center electrode side and to a portion of the ground electrode which corresponds to an outer circumference of the portion of the relieving layer tip on the center electrode side, and the noble metal tip further having the other end forming a gap with a front end portion of the center electrode, wherein the noble metal tip is made of a platinum alloy containing platinum as a principal component, wherein the relieving layer tip is made of a platinum alloy having a linear expansion coefficient between that of the platinum alloy constituting the noble metal tip and a metal material constituting the ground electrode, wherein a portion of the relieving layer tip to which the noble metal tip is joined has an area smaller than an area of the one end of the noble metal tip, and wherein a molten portion formed by melting at least the noble metal tip and the ground electrode by laser welding is provided on an entire outer circumference of a boundary portion between the ground electrode and the noble metal tip.

In addition, a tip made of a noble metal alloy may be provided on the front end portion of the center electrode. In this case, the gap is formed between the tip provided on the center electrode and the noble metal tip joined to the ground electrode.

According to the first aspect, the relieving layer tip is provided between the ground electrode and the noble metal tip. The relieving layer tip is made of the platinum alloy having a linear expansion coefficient between that of the platinum alloy constituting the noble metal tip and that of the metal material constituting the ground electrode. Therefore, the difference in thermal expansion is made relatively small between the ground electrode and the relieving layer tip, and between the relieving layer tip and the noble metal tip. Further, the joint portion of the relieving layer tip and the ground electrode, and the joint portion of the relieving layer tip and the noble metal tip can be prevented from receiving a large stress. Consequently, occurrence of the crack in the joint portions can be assuredly prevented.

According to the first aspect, the noble metal tip is joined, by resistance welding, to both the portion of the relieving layer tip on the center electrode side and the portion of the ground electrode which corresponds to an outer circumference of the portion of the relieving layer tip on the center electrode side. Further, the molten portion is provided on the entire outer circumference of the boundary portion between the ground electrode and the noble metal tip. That is, since the noble metal tip is joined to the ground electrode and to the relieving layer tip by resistance welding and laser welding, respectively, the noble metal tip is firmly joined to the ground electrode. In the noble metal tip and the ground electrode, the molten portion formed by melting the platinum alloy constituting the noble metal tip and the metal material constituting the ground electrode has a function the same as the relieving layer tip, thereby preventing a generation of large stress therebetween. Furthermore, the molten portion covers the joint portion (a boundary portion) between the noble metal tip and the relieving layer tip. Therefore, even though a crack occurs in the joint portion, the molten portion effectively prevents penetration of oxygen into the crack. As a result, the progress of oxidized scale can be securely prevented.

According to the first aspect, when each effect acts synergistically, separation of the noble metal tip from the ground electrode can be effectively prevented.

In addition, the portion of the relieving layer tip to which the noble metal tip is joined has an area smaller than that of the one end of the noble metal tip. That is, the cost of forming the relieving layer tip can be reduced using a relatively small relieving layer tip.

As disclosed in Japanese Patent Application Laid-Open (kokai) No. 2001-273966 in which the noble metal tip is not in contact with the ground electrode, a molten portion is formed in the outer circumference of a boundary portion between the noble metal tip and the relieving layer tip so that the penetration of oxygen to the joint portion therebetween is prevented, whereby the progress of oxidized scale can also be prevented. However, since the noble metal tip and the relieving layer tip is generally made of an alloy (noble metal alloy) which is not readily melt, a relatively large energy is necessary to melt the noble metal tip and the relieving layer tip. However, when increasing a melting energy of the laser beam, thermal energy tends to be accumulated in the noble metal tip and the relieving layer tip. Consequently, a difference in melting degree, i.e., amount, tends to occur between a part of the molten portion that is formed in the earlier stage of the welding process and a part of the molten portion that is formed in the later stage of the welding process. Thus, in order to form the uniform molten portion, it is necessary to precisely adjust the irradiating energy and the irradiating angle of the laser beam. However, such adjustment is very difficult.

According to the first aspect, the area of the relieving layer tip to which the noble metal tip is joined by resistance welding is smaller than the area of the one end of the noble metal tip. Therefore, when compared to a relieving layer tip having an area to which the noble metal tip is joined by resistance welding that is equal to the area of the one end of the noble metal tip, a relatively large amount of the metal material that constitutes the ground electrode is contained in the molten portion. The metal material constituting the ground electrode is normally a nickel alloy or the like, which requires less melting energy than that of the relieving layer tip. Thus, reduction in melting energy for forming the molten portion is achievable. Further, the uniform molten portion can be easily formed without precise adjusting an irradiating energy and irradiating angle of the laser beam. That is, when a relatively small relieving layer tip is used, it is possible to prevent an increase in cost, as well as to form the uniform molten portion. As a result, the progress of oxidized scale can be effectively prevented.

In accordance with a second aspect of the present invention, there is provided a spark plug for use in internal-combustion engines according to the first aspect, wherein, the area of the portion of the relieving layer tip to which the noble metal tip is joined by resistance welding is 45% or more to 75% or less of the area of the one end of the noble metal tip.

According to the second aspect, the area of the portion of the relieving layer tip to which the noble metal tip is joined by resistance welding is 45% or more of the area of the one end of the noble metal tip. Thus, large force is unlikely to be applied to the joint portion or the like between the noble metal tip and the relieving layer tip, whereby a generation of crack or the progress of oxidized scale in the joint portion can be securely prevented.

Moreover, since the area of the portion of the relieving layer tip to which the noble metal tip is joined by resistance welding is 75% or less of the area of the one end of the noble metal tip, the increase in cost can be further prevented, while securely forming the uniform molten portion.

In accordance with a third aspect of the present invention, there is provided a spark plug according to the first and second aspects, wherein, the area of the portion of the relieving layer tip to which the noble metal tip is joined by resistance welding is 60% or more to 75% or less of the area of the one end of the noble metal tip.

According to the third aspect, the area of the portion of the relieving layer tip to which the noble metal tip is joined by resistance welding is 60% or more to 75% or less of an area of the one end of the noble metal tip. Thus, large force is unlikely to be applied to the joint portion or the like between the noble metal tip and the relieving layer tip.

In accordance with a fourth aspect of the present invention, there is provided a spark plug for use in internal-combustion engines according to any one of aspects 1 to 3, wherein the relieving layer tip and the noble metal tip assume a disc-like shape, and wherein, an outer diameter of the portion of the relieving layer tip to which the noble metal tip is joined by resistance welding is 68% or more to 86% or less of an outer diameter of the one end of the noble metal tip.

According to the fourth aspect, the same effects as in the second aspect are achievable.

In accordance with a fifth aspect of the present invention, there is provided a spark plug for use in internal-combustion engines according to any one of aspects 1 to 4, wherein the relieving layer tip and the noble metal tip assume a disc-like shape, and wherein, the outer diameter of the portion of the relieving layer tip to which the noble metal tip is joined by resistance welding is 77% or more to 86% or less of the outer diameter of the one end of the noble metal tip.

According to the fifth aspect, the same effects as in the third aspect are achievable.

In accordance with a sixth aspect of the present invention, there is provided a spark plug for use in internal-combustion engines according to any one of aspects 1 to 5, wherein an area of the one end of the noble metal tip is 1.7 $mm^2$ or more.

In the noble metal tip, as the area of the noble metal tip to which the relieving layer tip or the ground electrode is joined is enlarged, the stress that occurs in the joint portion between the noble metal tip and the relieving layer tip or the like also increases. Thus, when a relatively large noble metal tip is employed in order to improve erosion resistance, a crack in the joint portion, the progress of oxidized scale and a separation of the noble metal tip are further concerns.

In the noble metal tip according to the sixth aspect, since the one end to which the ground electrode and the relieving layer tip are joined has the relatively large area of 1.7 $mm^2$ or more, there is concern that a separation of the noble metal tip might occur. However, by adopting the configuration of the first aspect, the separation of the noble metal tip can be effectively prevented. That is, when the one end (joint face) of the noble metal tip has relatively large area, it is advantageous to adopt the configuration of the first aspect.

In accordance with a seventh aspect of the present invention, there is provided a spark plug for use in internal-combustion engines according to any one of aspects 1 to 6, wherein the noble metal tip is joined by molten bond to the ground electrode in a state that the one end thereof is embedded in the ground electrode, and wherein an embedding depth of the noble metal tip in the ground electrode is 25% or less of a height of the noble metal tip before being embedded.

According to the seventh aspect, the noble metal tip is joined by a molten bond to the ground electrode in a state wherein the one end of the noble metal tip is embedded in the ground electrode, and the embedding depth of the noble metal tip in the ground electrode is 25% or less of the height of the noble metal tip before being embedded. When the noble metal tip is excessively embedded in the ground electrode, deformation (rise) of the ground electrode is likely to occur, which may cause a deficiency, such as an abnormal spark discharge between the deformed portion and the center electrode. However, according to the seventh aspect, such deficiency can be assuredly prevented.

In accordance with an eighth aspect of the present invention, there is provided a spark plug for use in internal-combustion engines according to any one of aspects 1 to 7, wherein, in the molten portion, a content of other metal materials is 3-10 where a platinum content in the molten portion is 1.

According to the eighth aspect, a content of other metal materials in the molten portion is 3-10 where a platinum content in the molten portion is 1. That is, since the metal materials that mainly constitute the ground electrode are melted, a melting energy required for forming the molten portion can be further reduced. Therefore, the uniform molten portion can be readily formed without precisely adjusting irradiation energy and an irradiation angle of a laser beam.

Further, according to the eighth aspect, it is possible to reduce a difference in coefficient of thermal expansion between the molten portion and the ground electrode, and between the molten portion and the noble metal tip. Thus, any crack in the molten portion can be prevented. As a result, the penetration of oxygen into the joint portion between the noble metal tip and the relieving layer tip can be prevented. Furthermore, the progress of oxidized scale can be securely and effectively prevented.

In addition, when the content of other metal materials in the molten portion is less than 3 where the content of platinum is 1, the melting energy for forming the molten portion increases, whereby a uniform molten portion is unlikely to be formed. Further, there is a possibility that the relatively large difference in coefficient of thermal expansion may occur between the molten portion and the ground electrode. This difference tends to cause a crack of the molten portion. On the other hand, when the content of other metal materials is over 10 in the molten portion, the noble metal tip is not securely joined to the ground electrode, and the effect of the separation resistance of the noble metal tip is not fully exhibited. Furthermore, a crack in the molten portion is more likely to occur.

In accordance with a ninth aspect of the present invention, there is provided a spark plug for use in internal-combustion engines according to the eighth aspect, wherein the molten portion satisfies the following relationship:

$$0.45 <= B/A <= 0.68,$$

where "A" (mm) is an outer diameter of an outermost portion of the molten portion in a radial direction, and where "B" (mm) is an inner diameter of an innermost portion of the molten portion in the radial direction.

According to the ninth aspect, the molten portion contains platinum and other metal materials with an excellent balance. As a result, a crack in the molten portion can be prevented, and the progress of oxidized scale can be effectively prevented.

In addition, when the B/A is less than 0.45 (i.e., the molten portion is deeply formed), the content of metal materials other than platinum in the molten portion may relatively increase. Therefore, there is a possibility that the difference in thermal expansion between the molten portion and the noble metal tip may slightly increase. On the other hand, when the B/A exceeds 0.68 (i.e., the molten portion is relatively shallowly formed), there is a possibility that the content of platinum in the molten portion may relatively increase, whereby the difference in thermal expansion between the molten portion and the ground electrode may slightly increase. However, even though the difference in thermal expansion between the molten portion and the ground electrode may slightly increase, a crack in the molten portion can be prevented by satisfying the eighth aspect (i.e., in the molten portion, the content of other metal materials is 3-10, when the platinum content is 1).

In accordance with a tenth aspect of the present invention, there is provided a spark plug for use in internal-combustion engines according to any one of aspects 1 to 9, wherein the molten portion is comprised of a series of plurality of melting regions which are formed by irradiating a laser beam, and wherein a surface of each melting region overlaps with the adjoining melting region in a range between 20% or more to 60% or less of the adjoining melting region.

According to the tenth aspect, the molten portion is comprised of a series of plurality of melting regions, and the surface of each melting region overlaps with 20% or more of the adjoining melting region. Therefore, the molten portion is further firmly formed, and the progress of oxidized scale or the like in the joint portion can be assuredly prevented.

On the other hand, since the surface of each melting region overlaps with 60% or less of the adjoining melting region (i.e., the melting region does not overlap with each other in excessive manner), the molten portion can be formed in a relatively short time. As a result, improvement in manufacturing efficiency is achievable.

BRIEF DESCRIPTION OF THE DRAWINGS

FIG. 3(*b*) is an enlarged section view showing the configuration of the molten portion.

DETAILED DESCRIPTION OF PREFERRED EMBODIMENTS

Figure 1:
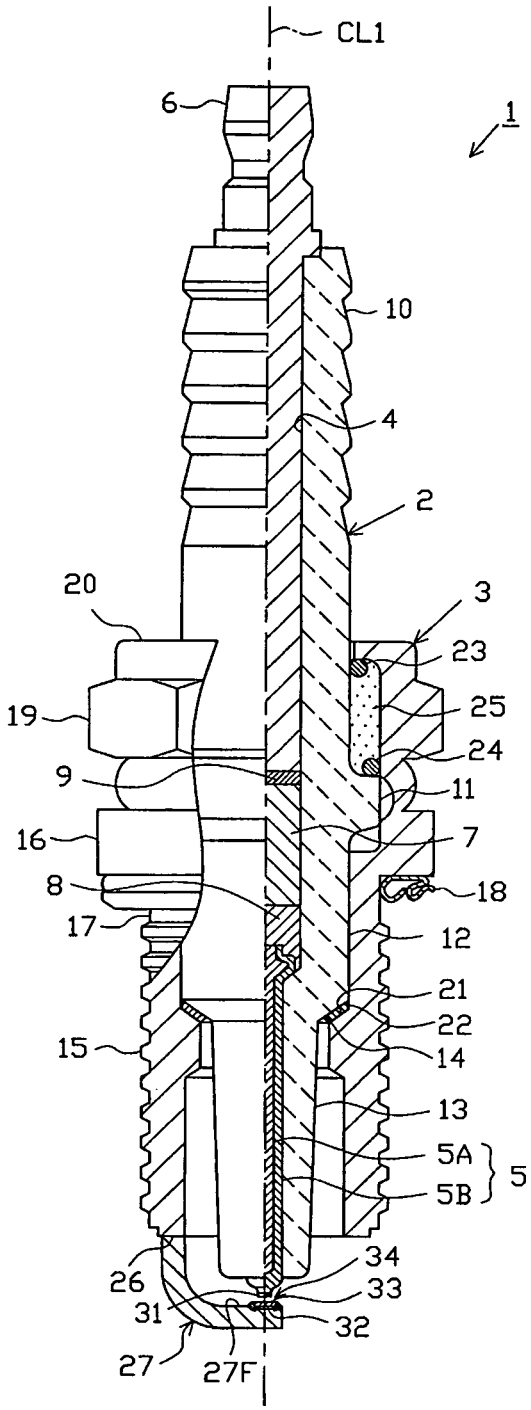
FIG. 1 is a partially sectioned front view of a spark plug according to an embodiment.

An embodiment of the present invention will now be described with reference to the drawings. FIG. 1 is a partially sectioned, front view of a spark plug 1 which is mainly used for engines, such as a gas engine, exposed under severe operating condition (hereinafter referred to as a spark plug). Notably, in FIG. 1, the spark plug 1 is depicted in such a manner that the direction of an axis CL1 of the spark plug 1 coincides with the vertical direction in FIG. 1. Further, in the following description, the lower side of FIG. 1 will be referred to as the front end side of the spark plug 1, and the upper side of FIG. 1 will be referred to as the rear end side of the spark plug 1.

The spark plug 1 is comprised of a cylindrical ceramic insulator 2 serving as an insulator, a cylindrical metal shell 3 which holds the ceramic insulator 2, etc.

As well known, the ceramic insulator 2 is made of alumina or the like through firing. The ceramic insulator 2 includes a rear-end-side trunk portion 10 formed on the rear end side. A larger diameter portion 11 projects radially outward on the front end side of the rear-end-side trunk portion 10. An intermediate trunk portion 12 is formed on the front end side of the larger diameter portion 11 and has a diameter smaller than that of the larger diameter portion 11. A leg portion 13 is formed on the front end side of the intermediate trunk portion 12 and has a diameter smaller than that of the intermediate trunk portion 12. Of the ceramic insulator 2, the larger diameter portion 11, the intermediate trunk portion 12, and the greater part of the leg portion 13 are accommodated within the metal shell 3. A tapered step portion 14 is formed at a connection portion between the leg portion 13 and the intermediate trunk portion 12. The ceramic insulator 2 is engaged with the metal shell 3 at the step portion 14.

Further, the ceramic insulator 2 has an axial bore 4 which penetrates and extends through the ceramic insulator 2 along the axis CL1. A center electrode 5 is inserted into and fixed to a front end portion of the axial bore 4. The center electrode 5 assumes a rod-like shape (cylindrical columnar shape) as a whole. A front end portion of the center electrode 5 is made flat and projects from the front end of the ceramic insulator 2. The center electrode 5 is comprised of an inner layer 5A formed of copper or a copper alloy, and an outer layer 5B formed of a nickel alloy whose predominant component is nickel (Ni). Furthermore, a cylindrical columnar noble metal tip 31 made of a noble metal alloy (e.g., a platinum alloy or an iridium alloy) is joined to the front end portion of the center electrode 5.

A terminal electrode 6 is fixedly inserted into a rear end portion of the axial bore 4 such that the terminal electrode 6 projects from the rear end of the ceramic insulator 2.

Furthermore, a cylindrical columnar resistor 7 is disposed in the axial bore 4 between the center electrode 5 and the terminal electrode 6. Each end of the resistor 7 is electrically connected to the center electrode 5 and the terminal electrode 6, respectively, via electrically conductive glass seal layers 8 and 9.

In addition, the metal shell 3 is formed of metal such as low carbon steel and has a cylindrical shape. A thread portion (external thread portion) 15, for mounting the spark plug 1 onto an engine head, is formed on the outer circumferential surface of the metal shell 3. Further, a seat portion 16 is formed on the outer circumferential surface located on the rear end side of the thread portion 15. A ring-shaped gasket 18 is fitted into a thread neck potion 17 at the rear end of the thread portion 15. Moreover, a tool engagement portion 19 and a crimped portion 20 are provided at the rear end of the metal shell 3. The tool engagement portion 19 has a hexagonal cross section. A tool, such as a wrench, engages with the tool engagement portion 19 when the spark plug 1 is mounted to the engine head. The crimped portion 20 holds the ceramic insulator 2 at the rear end portion.

Furthermore, a tapered step portion 21 with which the ceramic insulator 2 is engaged is provided on the inner circumferential surface of the metal shell 3. The ceramic insulator 2 is inserted into the metal shell 3 from its rear end side toward the front end side. In a state in which the step portion 14 of the ceramic insulator 2 is engaged with the step portion 21 of the metal shell 3, a rear-end-side opening portion of the metal shell 3 is crimped radially inward; i.e., the above-mentioned crimped portion 20 is formed, whereby the ceramic insulator 2 is held by the metal shell 3. Notably, an annular plate packing 22 is interposed between the step portions 14 and 21. Thus, the airtightness of an internal-combustion chamber is secured, whereby an air-fuel mixture which enters the clearance between the inner circumferential surface of the metal shell 3 and the leg portion 13 of the ceramic insulator 2 from exposure to the interior of the internal-combustion chamber is prevented from leaking to the outside.

Moreover, in order to render the sealing by the crimping more perfect, on the rear end side of the metal shell 3, annular ring members 23 and 24 are interposed between the metal shell 3 and the ceramic insulator 2, and powder of talc 25 is charged into the space between the ring members 23 and 24. That is, the metal shell 3 holds the ceramic insulator 2 via the plate packing 22, the ring members 23 and 24, and the talc 25.

A ground electrode 27 made of a Ni alloy is joined to a front end portion 26 of the metal shell 3. The ground electrode 27 has a front end portion thereof which is bent so that a side surface 27F thereof faces a front end face of the center electrode 5 (the noble metal tip 31).

Figure 2:
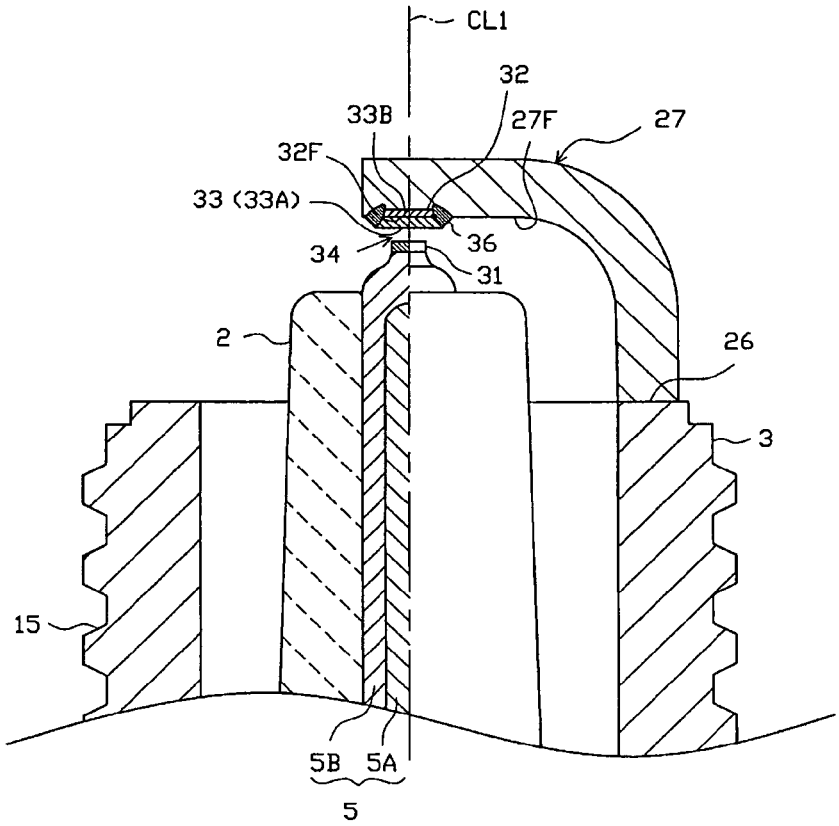
FIG. 2 is an enlarged, partially sectioned front view of a front end portion of the spark plug.

Further, as shown in FIG. 2, a disc-like relieving layer tip 32 is embedded in and joined to the side face 27F of the ground electrode 27 by resistance welding. Furthermore, a disc-like noble metal tip 33 is joined by resistance welding or the like to a portion of the relieving layer tip 32 positioned on the center electrode 5 side (hereinafter referred to as an upper face portion 32F) and to a portion of the ground electrode 27 corresponding to an outer circumference of the upper face portion 32F. Moreover, a spark discharge gap 34 is formed between a front end of the noble metal tip 31 and the other end 33A of the noble metal tip 33 so that a spark is discharged along the axis CL1.

In addition, in this embodiment, the noble metal tip 33 is made of a Pt alloy byway of example and not limitation, a Pt—Ir alloy, a Pt—Rh alloy, a Pt—Ni alloy or a Pt—Ir—Rh alloy containing platinum (Pt) as a principal component. Moreover, the relieving layer tip 32 is made of a Pt alloy containing platinum as a principal component and having a linear expansion coefficient between that of the Pt alloy constituting the noble metal tip 33 and that of the Ni alloy constituting the ground electrode 27 (e.g., Pt—Ni alloy or the like). In order to increase a volume of the noble metal tip 33, the noble metal tip 33 is made relatively thick (e.g., 0.4 mm or more), while the relieving layer tip 32 is made thin (e.g., 0.2 mm to 0.35 mm) compared to the noble metal tip 33. Thus, the ground electrode 27 in which the relieving layer tip 32 is embedded can be prevented from the deformation normally caused when a relieving layer tip 32 is embedded in a ground electrode, and the noble metal tip 33 can be more assuredly joined to the ground electrode 27 and the relieving layer tip 32 by resistance welding.

Furthermore, the cross-sectional area of the relieving layer tip 32 along with the center axis of the relieving layer tip 32 is smaller than that of the noble metal tip 33 along with the center axis of the noble metal tip 33. As a result, the area of the upper face portion 32F of the relieving layer tip 32 to which the noble metal tip 33 is joined is made smaller than the area of a one end 33B of the noble metal tip 33. More particularly, the area of the upper face portion 32F of the relieving layer tip 32 falls within a range from 45% or more to 75% or less (e.g., 60%) of the area of the one end 33B of the noble metal tip 33 (i.e., the outer diameter of the upper face portion 32F of the relieving layer tip 32 falls within a range between 68% or more and 86% or less of the outer diameter of the one end 33B of the noble metal tip 33). In this embodiment, the noble metal tip 33 has relatively a large diameter (more than ϕ1.5 mm) and a relatively large cross-sectional area (e.g., 1.7 $mm^2$ or more) in order to further increase the volume of the noble metal tip 33.

Figure 3A:
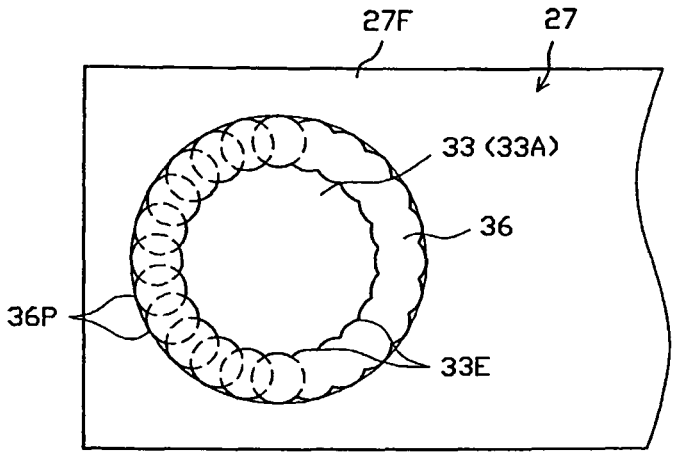
FIG. 3(*a*) is a partially enlarged view showing a configuration of a molten portion.
Figure 3B:
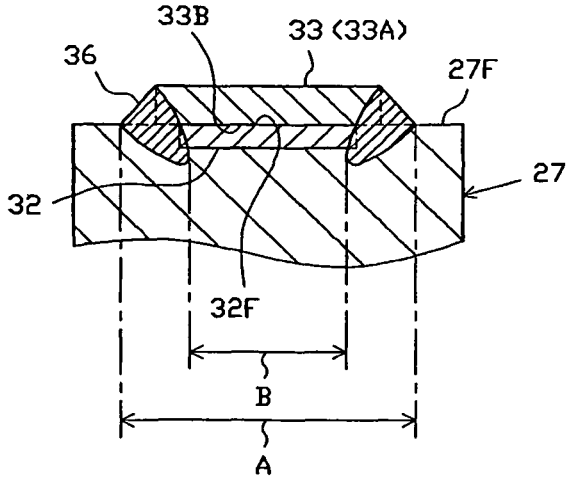

Furthermore, an annular molten portion 36 is formed to penetrate an entire circumference of the boundary portion of the ground electrode 27 and the one end 33B of the noble metal tip 33. The molten portion 36 is formed by melting the Pt alloy constituting, i.e., forming, the relieving layer tip 32, the Pt alloy constituting, i.e., forming, the noble metal tip 33, and the Ni alloy constituting, i.e., forming, the ground electrode 27 by laser welding. As shown in FIG. 3(*a*), the molten portion 36 is comprised of a plurality of molten points 36P that is formed in a series to form a melting region. The plurality of molten point 36P is formed by intermittently irradiating a laser beam. In addition, a surface of each molten point 36P overlaps with a surface of the adjoining molten point 36P in a range between 20% or more to 60% or less (about 30% in this embodiment) of the surface area of the adjoining molten point 36P. Moreover, the outer circumference of the other end 33A of the noble metal tip 33 is slightly melted by an irradiation of the laser beam. As a result, a plurality of corners 33E is formed in the outer circumferential of the other end 33A of the noble metal tip 33.

Furthermore, as mentioned above, the molten portion 36 is formed by melting the Pt alloy constituting the relieving layer tip 32, the Pt alloy constituting the noble metal tip 33, and the Ni alloy constituting the ground electrode 27. As shown in FIG. 3(*b*), the content of the Ni alloy is relatively greater than that of the both Pt alloys. In other words, the amount of Ni alloy in the molten portion 36 is greater than the amount of Pt alloy in the molten portion 36. As a result, the content of other metal materials is 3 to 10 (preferably 5 to 8) where the content of Pt in the molten portion 36 is 1. In addition, the embedding depth of the noble metal tip 33 in the ground electrode 27 is 25% or less, which is relatively a small amount, of the height of the noble metal tip 33 before being embedded.

The molten portion 36 satisfies the following relationship:

$$0.45<=B/A<=0.68,$$

where "A" (mm) is an outer diameter of an outermost portion of the molten portion 36 in a radial direction, and where "B" (mm) is an inner diameter of an innermost portion of the molten portion 36 in the radial direction.

Next, a method for manufacturing the spark plug 1 will be described. First, the metal shell 3 is prepared beforehand. That is, a through-hole is formed in a columnar-shaped metal material (e.g., iron material or stainless steel material, such as S17C and S25C) by a cold forging processing to produce a primary body of the metal shell 3. Then, an outer shape of the thus-produced body is prepared by a cutting process to thereby form a metal shell intermediate body.

Next, the ground electrode 27 made of Ni alloy or the like is joined by resistance welding to a front end face of the metal shell intermediate body. Since the resistance welding causes so-called "rundown", the thread portion 15 is formed in a predetermined region of the metal shell intermediate by a rolling process after removing the "rundown". In this way, the metal shell 3 to which the ground electrode 27 is welded is obtained. Zinc plating or nickel plating is applied to the metal shell 3 to which the ground electrode 27 is welded. Notably, chromate treatment may be further performed to the surface of the thus-plated metal shell 3 in order to improve corrosion-resistance thereof.

On the other hand, the insulator 2 is separately formed from the metal shell 3. For example, base powder containing alumina as a principal component and binder are subjected to granulation and the thus-granulated material is subjected to rubber pressing to form a cylindrical green mold body. Then, the thus-formed green mold body is subjected to cutting and grinding process. Thereafter, the resulting body is fired in a furnace. After firing, the insulator 2 is formed through various grinding processes.

The center electrode 5 is separately manufactured from the metal shell 3 and the ceramic insulator 2. That is, nickel alloy is formed in a forging process, and the inner layer 5A made of copper alloy is formed in the center part of the alloy in order to improve heat conduction. The noble metal tip 31 is joined to the front end portion of the center electrode 5 by resistance welding, laser welding, or the like.

Then, the thus-formed ceramic insulator 2, the center electrode 5, the resistor 7 and the terminal electrode 6 are sealed and fixed by the glass seal layers 8 and 9. Generally, the glass seal layers 8 and 9 are prepared by blending borosilicate glass and metal powder, and deposited in the axial bore 4 of the ceramic insulator 2 so as to sandwich the resistor 7. Thereafter, the glass seal layers 8 and 9 are pressed in by the terminal electrode 6 from the rear end, while heating it in the furnace. At this time, a glaze layer provided on a surface of the rear end side body portion 10 of the ceramic insulator 2 may be calcined simultaneously, or a glaze layer may be formed in advance.

Subsequently, the thus-formed ceramic insulator 2 provided with the center electrode 5 and the terminal electrode 6 is assembled together with the metal shell 3 having the ground electrode 27. More specifically, a relatively thin-walled rear-end opening portion of the metal shell 3 is caulked radially inward; i.e., the above-mentioned caulking portion 20 is formed, thereby fixing the ceramic insulator 2 and the metal shell 3 together.

Figure 4A:
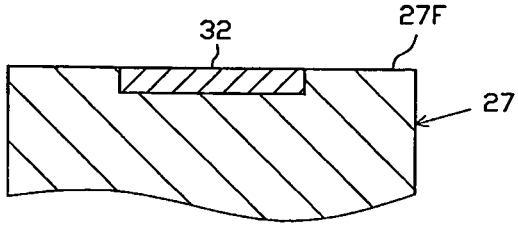
FIGS. 4(*a*) to (*c*) are enlarged section views showing a joint technique of the relieving layer tip, the noble metal tip and the ground electrode.
Figure 4B:
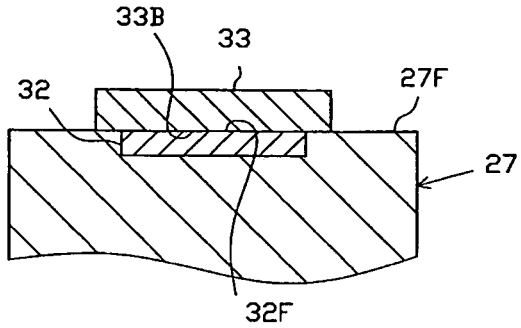
Figure 4C:
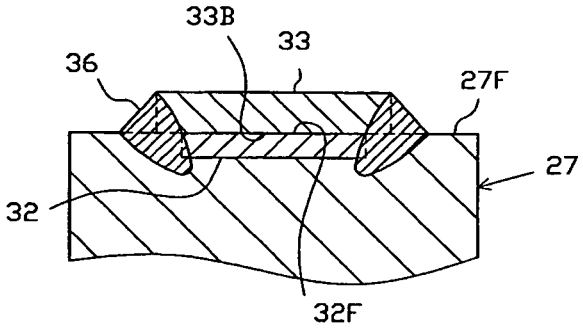

Subsequently, the relieving layer tip 32 and the noble metal tip 33 both of which are made of a predetermined Pt alloy, respectively, are joined to the side face 27F of the ground electrode 27 by resistance welding. That is, as shown in FIG. 4(*a*), in the side face 27F of the ground electrode 27, the relieving layer tip 32 is positioned in a predetermined location that is opposed to the noble metal tip 31, and thereafter the relieving layer tip 32 is embedded in and joined to the ground electrode 27 by resistance welding. Then, as shown in FIG. 4(*b*), the one end 33B of the noble metal tip 33 is joined to the upper face portion 32F of the relieving layer tip 32 and the ground electrode 27 by resistance welding, while the noble metal tip 33 is positioned so as to cover the relieving layer tip 32. Next, as shown in FIG. 4(*c*), a laser beam is intermittently irradiated to the boundary portion of the ground electrode 27 and the one end 33B of the noble metal tip 33 so as to form the annular molten portion 36 comprised of the plurality of molten points 36P, whereby the relieving layer tip 32 and the noble metal tip 33 are joined to the ground electrode 27. In addition, an irradiating position of a laser beam is determined so that the surface of the molten point 36P overlaps with 20% or more to 60% or less area of the adjoining molten point 36P, which is formed previously.

Finally, the ground electrode 27 is bent so as to form the spark discharge gap 33 formed between the noble metal tip 31 of the center electrode 5 and the noble metal tip 33 of the ground electrode 27, thereby producing the spark plug 1.

According to the embodiment, the relieving layer tip 32 is made of a Pt alloy having a linear expansion coefficient between that of a Pt alloy constituting the noble metal tip 33 and that of a Ni alloy constituting the ground electrode 27, and the relieving layer tip 32 is formed, i.e., disposed, between the noble metal tip 33 and the ground electrode 27. Thus, the difference in thermal expansion is made relatively small between the ground electrode 27 and the relieving layer tip 32, and between the relieving layer tip 32 and the noble metal tip 33. Further, the joint portion of the relieving layer tip 32 and the ground electrode 27, and the joint portion of the relieving layer tip 32 and the noble metal tip 33 can be prevented from receiving a large stress. Consequently, occurrence of the crack in the joint portions can be assuredly prevented.

Further, the noble metal tip 33 is joined, by resistance welding, to both an upper face portion 32F of the relieving layer tip 32 that is embedded in the ground electrode 27 and the portion of the ground electrode 27 which corresponds to the outer circumference of the upper face portion 32F of the relieving layer tip 32. Furthermore, the molten portion 36 is formed by laser welding on the entire circumference of the boundary portion between a portion of the ground electrode 27 on the center electrode 5 side and the one end 33B of the noble metal tip 33. That is, since the noble metal tip 33 is joined to the ground electrode 27 and the relieving layer tip 32 by resistance welding and laser welding, respectively, the noble metal tip 33 is firmly joined to the ground electrode 27 or the like. In the noble metal tip 33 and the ground electrode 27, the molten portion 36 formed by melting the Pt alloy constituting the noble metal tip 33 and the Ni alloy constituting the ground electrode 27 has a function the same as the relieving layer tip 32, thereby preventing a generation of large stress therebetween. Moreover, the molten portion 36 covers the joint portion (a boundary portion) between the noble metal tip 33 and the relieving layer tip 32. Therefore, even though a crack occurs in the joint portion, the molten portion 36 effectively prevents penetration of oxygen into the crack. As a result, the progress of oxidized scale can be securely prevented.

As mentioned above, according to the embodiment, when each effect acts synergistically, separation of the noble metal tip 33 from the ground electrode 27 can be effectively prevented.

Furthermore, the relieving layer tip 32 has the smaller area to which the noble metal tip 33 is joined (the upper face portion 32F) by resistance welding than the area of the one end 33B of the noble metal tip 33. That is, using the relatively small relieving layer tip 32, it is possible to prevent an increase in cost for forming the relieving layer tip 32. Further, reduction in melting energy for forming the molten portion 36 is achievable. Furthermore, the uniform molten portion 36 can be easily formed without precisely adjusting the irradiating energy and irradiating angle of the laser beam. By setting the content of platinum in the molten portion 36 to 1, and setting the content of other metal materials to 3-10, the melting energy required for forming the molten portion 36 can be further reduced. As a result, the molten portion 36 can be more easily and uniformly formed.

By setting the content of platinum in the molten portion 36 to 1 and the content of other metal materials to 3-10, it is possible to reduce a difference in coefficient of thermal expansion between the molten portion 36 and the ground electrode 27, and between the molten portion 36 and the noble metal tip 33. Thus, any crack in the molten portion 36 can be certainly prevented. As a result, the penetration of oxygen into the joint portion of the noble metal tip 33 and the relieving layer tip 32 can be assuredly prevented. Furthermore, the progress of oxidized scale can be securely prevented.

Specifically, in the embodiment, since the outer diameter "A" and the inner diameter "B" of the molten portion 36 is defined to satisfy the relationship of $0.45 <= B/A <= 0.68$, the molten portion contains platinum and other metal materials with an excellent balance. As a result, a crack in the molten portion 36 can be securely prevented.

In addition, the embedding depth of the noble metal tip 33 in the ground electrode 27 is 25% or less of the height of the noble metal tip 33 before being embedded. Thus, deformation (rise) of the ground electrode 27 can be prevented. As a result, a deficiency, such as an abnormal spark discharge caused between the deformed portion and the noble metal tip 31, can be assuredly prevented.

The molten portion 36 is comprised of a series of plurality of melting regions 36P, and the surface of each melting region 36P overlaps with 20% or more of the adjoining melting region 36P. Therefore, the molten portion 36 is further firmly formed, and the progress of oxidized scale or the like in the joint portion can be assuredly prevented. On the other hand, since the surface of each melting region 36P overlaps with 60% or less of the adjoining melting region 36P, the molten portion 36 can be formed in a relatively short time. As a result, improvement in manufacturing efficiency is achievable.

Furthermore, since a plurality of corners 33E where electric field tends to concentrate is formed on the other end 33A of the noble metal tip 33 by means of laser welding, improvement in ignitability is achievable.

Figure 5:
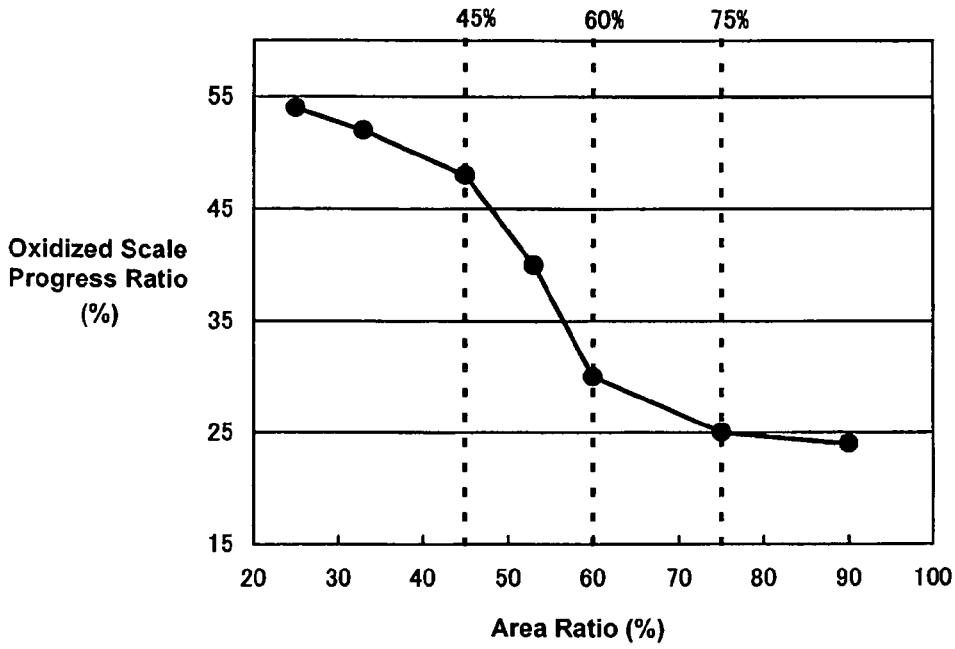
FIG. 5 is a graph showing a relationship between an area ratio and an oxidized scale progress ratio.
Figure 6:
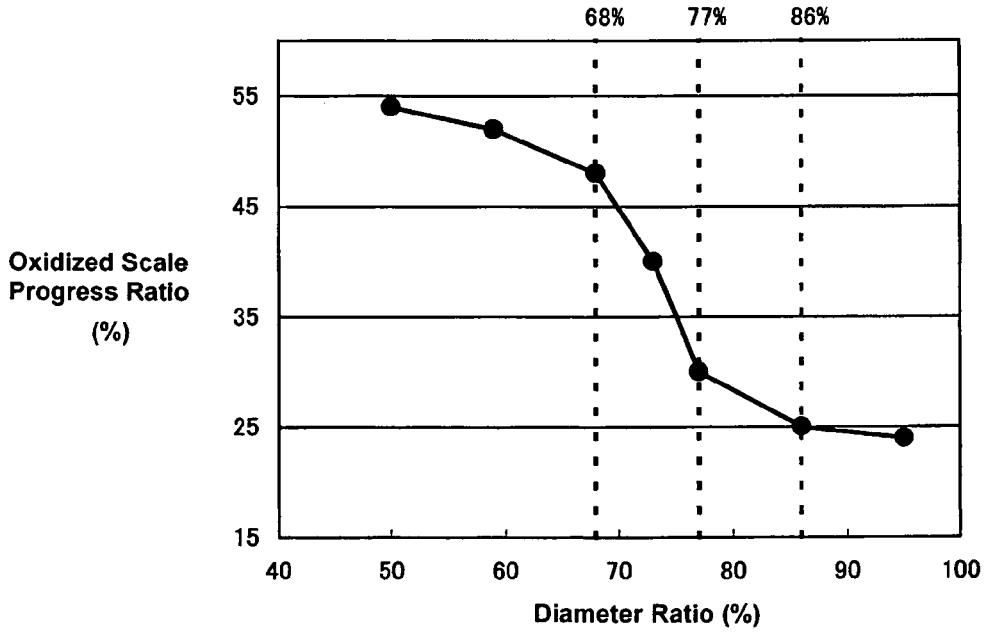
FIG. 6 is a graph showing a relationship between a diameter ratio and the oxidized scale progress ratio.

Next, in order to confirm the effects of the spark plug having the above-described configuration according to the embodiment, the following tests were conducted. Various spark plug samples were prepared for a desktop burner test. The samples differ in an area ratio of the upper face portion of the relieving layer tip to the one end of the noble metal tip, and differ in a diameter ratio of the outer diameter of the upper face portion of the relieving layer tip to the outer diameter of the one end of the noble metal tip. Details of the desktop burner test are following. Each sample was heated for 2 minutes so that the temperature of the noble metal tip (on the ground electrode side) was at 1100 degrees C., and thereafter, the heated sample was cooled for 1 minute. This process was counted as one cycle. After the samples were subject to 1000 cycles, the cross-sections of the samples were observed to measure the ratio of the oxidized scale length (oxidized scale progress ratio) to the length of the boundary portion between the relieving layer tip and the noble metal tip. FIG. 5 is a graph showing a relationship between the area ratio and the oxidized scale progress ratio. FIG. 6 is a graph showing a relationship between the diameter ratio and the oxidized scale progress ratio.

As shown in FIGS. 5 and 6, the samples having the area ratio of 45% or more (i.e., having the diameter ratio of 68% or more) exhibited a decrease in oxidized scale progress ratio to 50% or less. Thus, it is apparent that separation of the noble metal tip is fully prevented. Because the relieving layer tip was formed with sufficient volume, the stress generated in the joint portion and so between the noble metal tip and the relieving layer tip was relatively small. Furthermore, the samples having the area ratio of 60% or more (i.e., the diameter ratio of 77% or more) exhibited a decrease in oxidized scale progress ratio to 30% or less. Thus, the separation of the noble metal tip is further prevented.

On the other hand, when comparing the samples having the area ratio of 75% (i.e., having the diameter ratio of 86%) with the samples having the area ratio of over 75% (i.e., having the diameter ratio of over 86%), the samples having the larger area ratio (diameter ratio) exhibited an improvement in anti-separation properties. However, an extent of such improvement was relatively small.

As mentioned above, in order to maintain a full anti-separation properties of the noble metal tip and to prevent an increase in cost for forming the relieving layer tip, it is advantageous to employ the relieving layer tip having the area ratio of 45% or more to 75% or less (i.e., the diameter ratio of 68% or more to 86% or less). Moreover, in light of a further improvement in anti-separation properties of the noble metal tip, it is very effective to employ the relieving layer tip having the area ratio of 60% or more to 75% or less (i.e., the diameter ratio of 77% or more to 86% or less).

Subsequently, another desktop burner test was conducted in the same procedure as above. By changing the laser welding conditions at the time of joining the noble metal tip to the ground electrode, various samples which differ in the amount of platinum and that of other metal materials contained in the molten portion were prepared. After conducting 1000 cycles, the sample was embedded in a resin. Then, the boundary portion between the molten portion and the noble metal tip or the ground electrode was observed in a sectioned face including the center axis of the noble metal tip to measure a length of a portion where a crack was observed in the boundary portion. Based on this measurement, a ratio of the length of the portion where the crack was observed to the length of the boundary portion (a crack ratio in the molten portion) was calculated. In addition, the noble metal tip was heated at 950 degrees C. The noble metal tip was made of a Pt—Ni alloy, or a Pt—Ir alloy which contained 50 mass % or more to less than 100 mass % Pt. Further, the samples for the desktop burner test and the samples for composition analysis were formed under the same conditions. The content of Pt and that of other metal materials in the molten portion were measured by analyzing the surface of the molten portion of the sample with EPMA.

Figure 7:
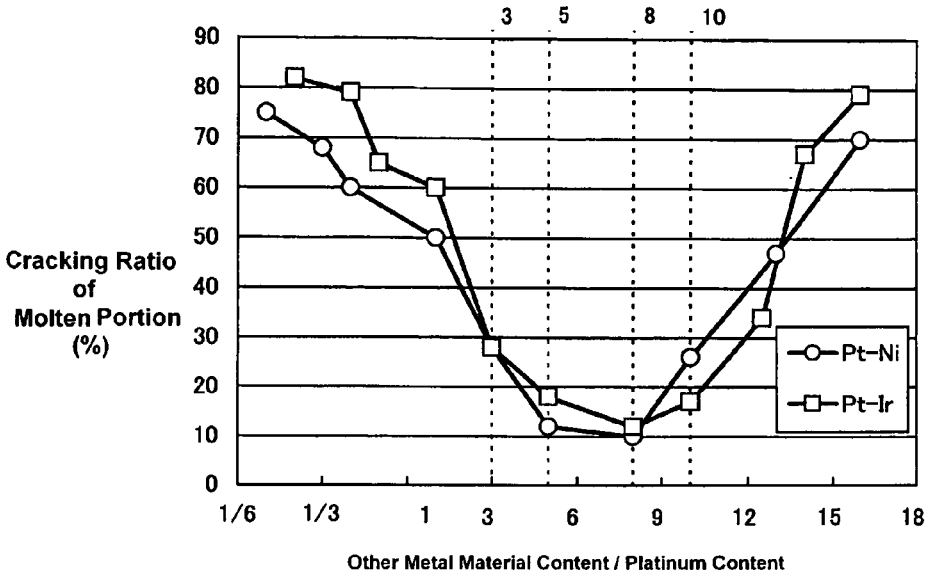
FIG. 7 is a graph showing a relationship between a ratio of other metal material content to platinum content and a crack ratio of molten portion.

FIG. 7 is a graph showing a relationship between a ratio of other metal material content to platinum content and the crack ratio of the molten portion. In FIG. 7, the test results of the samples that include the noble metal tip made of a Pt—Ni alloy is plotted with a white circle (○), and the test results of the samples that include the noble metal tip made of a Pt—Ir alloy is plotted with a white square (□).

As shown in FIG. 7, the samples having the ratio of other metal material content to platinum content which falls within a range between 3 or more and 10 or less (i.e., the samples having the other metal material content of 3 to 10 in the molten portion) showed 30% or less crack ratio in the molten portion. It is apparent that the crack is effectively prevented in the molten portion. Because the content of other metal materials in the molten portion was 3 to 10 where the Pt content was 1, the difference in thermal expansion of the molten portion and that of the ground electrode or the noble metal tip was made relatively small.

Moreover, in the samples having the Pt content of 1 and the other metal material content of 5 to 8 in the molten portion, the crack ratio of the molten portion was 20% or less, even though various noble metal tips each having different Pt content were employed. It was apparent that the crack in the molten portion was effectively prevented.

According to the above test results, it is preferable that the Pt content in the molten portion be 1 and the content of other metal materials be 3 to 10, more preferably, 5 to 8, in order to prevent the crack in the molten portion.

Next, various samples (1 to 7) which differ in depth of the molten portion (i.e., the value of B/A, where "A" (mm) is the outer diameter of the outermost portion of the molten portion in a radial direction, and where "B" (mm) is the inner diameter of the innermost portion of the molten portion in the radial direction) were prepared by differentiating an irradiation energy of the laser beam or the like, while maintaining a proportion of the Pt content to the other metal material content in the molten portion to fall within the range from 1:3 to 1:10. The samples were subjected to a desktop burner test, and the crack ratio in the molten portion were calculated. In the test, "○" was awarded for the samples whose crack ratio was 30% or less, representing the excellent effect for preventing the crack in the molten portion. On the other hand, "Δ" was awarded for the samples whose crack ratio was over 30%, representing the relatively poor effect for preventing the crack in the molten portion. The test results of the samples 1-7 are shown in Table 1.

In the test, the noble metal tip was heated at 1000 degrees C., which was tougher conditions than that of the above-mentioned test of 950 degrees C. Moreover, a noble metal tip made of a Pt—Ir alloy was employed.

TABLE 1

| Sample No. | B/A | Result |
|---|---|---|
| 1 | 0.39 | Δ |
| 2 | 0.45 | ○ |
| 3 | 0.51 | ○ |
| 4 | 0.59 | ○ |
| 5 | 0.68 | ○ |
| 6 | 0.75 | Δ |
| 7 | 0.80 | Δ |

As shown in Table 1, the samples (2 to 5) whose molten portion had the B/A of 0.45 or more to 0.68 or less could prevent the crack in the molten portion even though the test conditions were tougher. It was confirmed that these samples were excellent in preventing the crack in the molten portion.

According to the test results, the molten portion is preferably formed to satisfy the relationship of $0.45 <= B/A <= 0.68$, while maintaining the proportion of the Pt content to the other metal material content in the molten portion to fall within the range from 1:3 to 1:10.

The present invention is not limited to the above-described embodiment, but may be embodied, for example, as follows. Of course, application examples and modifications other than those described below are also possible.

Figure 8:
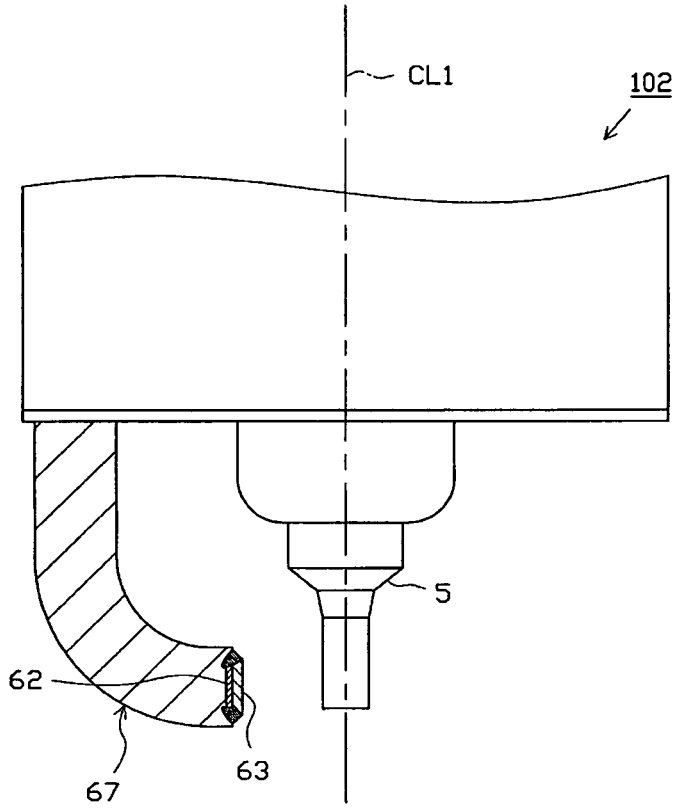
FIG. 8 is a partially sectioned, front view of a spark plug according to another embodiment.

(a) In the above-mentioned embodiments, the technical idea of the present invention is applied to a spark plug 1 in which a spark discharge is generated in the spark discharge gap 34 between the noble metal tips 31, 33 in the axis CL1 direction, i.e., a parallel electrode type. However, the technical idea of the present invention can also be applied to other types of spark plugs. For example, as shown in FIG. 8, the present invention can be applied to a spark plug 102 in which a noble metal tip 63 is joined to a relieving layer tip 62 that is joined to a front end face of the ground electrode 67 and the ground electrode 67, and in which a spark discharge is generated along the direction generally perpendicular to the axis CL1.

Figure 9A:
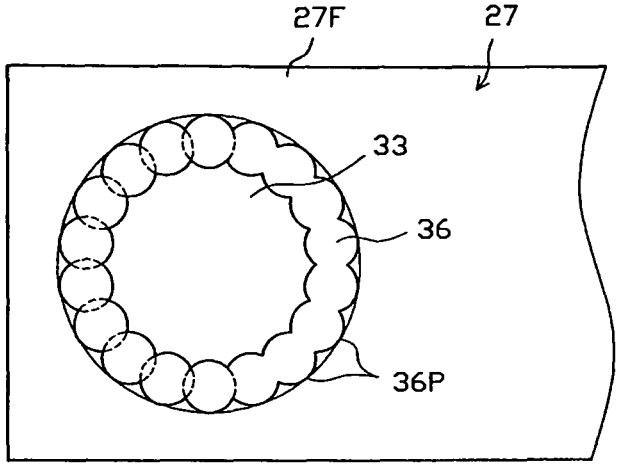
FIGS. 9(*a*), (*b*) are enlarged views showing a configuration of the molten portion according to another embodiment.
Figure 9B:
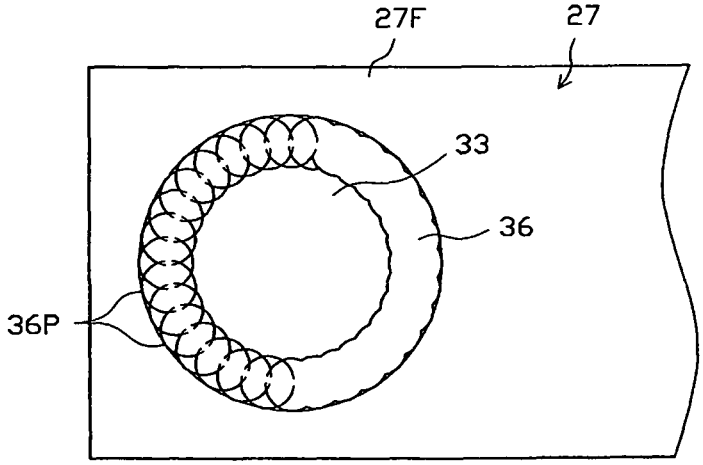

(b) In the above-mentioned embodiments, the molten portion 36 is formed so that the surface of each molten point 36P overlaps with about 30% of the surface area of the adjoining molten point 36P. As shown in FIG. 9(*a*), the surface of the molten point 36P may overlap with about 10% of the surface of the adjoining molten point 36P. In this case, laser welding can be more effectively performed. Moreover, as shown in FIG. 9(*b*), the surface of the molten point 36P may overlap with 40% or more of the surface of the adjoining molten point 36P. Thus, when the molten point 36P overlaps with 40% or more of the adjoining molten point 36P, further improvement in joint strength between the noble metal tip 33 and the ground electrode 27 is achievable. Further, anti-separation properties can be improved.

Figure 10:
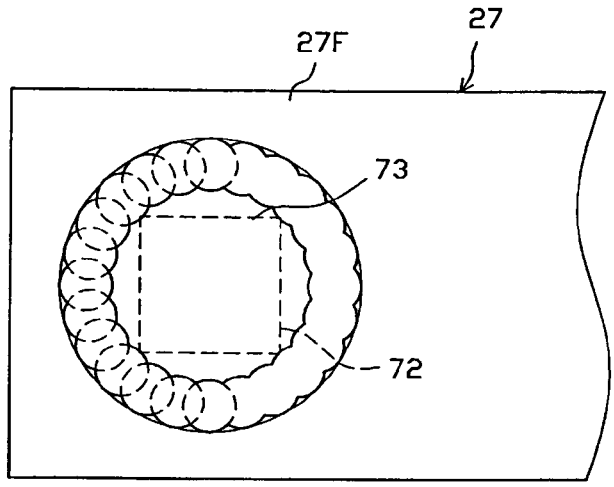
FIG. 10 is an enlarged diagram for explaining a shape of relieving layer tip according to another embodiment.

(c) In the above-mentioned embodiments, the relieving layer tip 32 and the noble metal tip 33 assumed a disc-like shape. However, the shapes of the relieving layer tip 32 or the noble metal tip 33 are not limited to the above-embodiment. For example, as shown in FIG. 10, while using a disc-like noble metal tip 73, a relieving layer tip 72 (a portion indicated with dashed line in FIG. 10) may assume a rectangular shape in the cross-section.

Figure 11A:
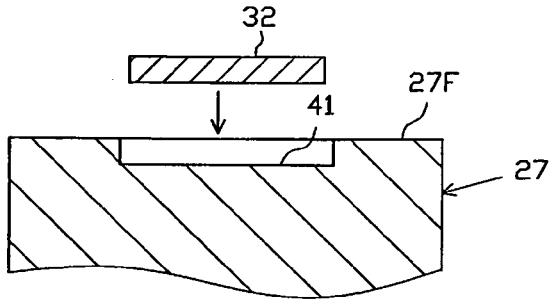
FIGS. 11(*a*), (*b*) are enlarged section views showing a joint technique of the relieving layer tip and the ground electrode according to another embodiment.
Figure 11B:
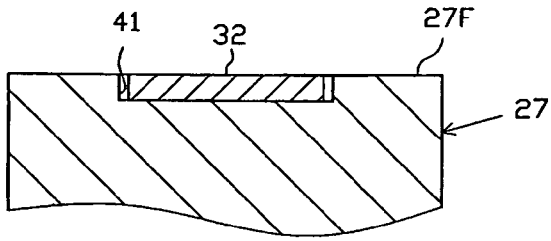

(d) In the above embodiments, the relieving layer tip 32 is joined to the flat side face 27F of the ground electrode 27 by resistance welding. However, as shown in FIGS. 11(*a*) and 11(*b*), a joint hole 41 is formed in a position opposed to the noble metal tip 31 so that the relieving layer tip 32 is accommodated in the joint hole 41 and joined to the ground electrodes 27 by resistance welding. In this case, it is preferable that an inner diameter of the joint hole 41 be made slightly larger than an outer diameter of the relieving layer tip 32. When the inner diameter of the joint hole 41 be made slightly larger than the outer diameter of the relieving layer tip 32, sufficient melting energy can be provided between a bottom of the joint hole 41 and a lower face of the relieving layer tip 32. As a result, the relieving layer tip 32 can be firmly joined to the ground electrode 27. Moreover, the relieving layer tip 32 is readily disposed in the joint hole 41 if the joint hole 41 is made relatively large. In addition, an annular gap formed between the relieving layer tip 32 and a side wall of the joint hole 41 can be filled with a melted Ni alloy that constitutes the ground electrode 27 by conducting laser welding or the like.

Figure 12:
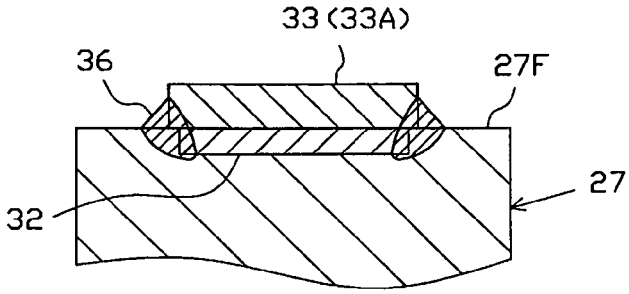
FIG. 12 is an enlarged view showing a configuration of the molten portion according to another embodiment.

(e) The other end 33A of the noble metal tip 33 is melted by laser welding, and the corners 33E are formed in the outer circumferential portion of the other end 33A. However, as shown in FIG. 12, the noble metal tip 33 may be laser welded without forming the corners 33E on the other end 33A of the noble metal tip 33 by changing the irradiating energy and angles.

(f) Although nothing is referred in the above embodiments, the center axis of the relieving layer tip 32 may coincide with that of the noble metal tip 33.

(g) In the above-mentioned embodiments, although the noble metal tip 31 is formed in the front end portion of the center electrode 5, the noble metal tip 31 may be absent.

(h) According to the above-described embodiments, the ground electrode 27 is joined to the front end portion of the metal shell 3. However, a portion of the metal shell (or a portion of a front-end metal piece welded beforehand to the metal shell) may be cut so as to form the ground electrode (e.g., Japanese Patent Application Laid-Open (kokai) No. 2006-236906). Further, the ground electrode 27 may be joined to a side face of the front end portion 26 of the metal shell 3.

(i) In the above-described embodiments, the tool engagement portion 19 has a hexagonal cross section. However, the shape of the tool engagement portion 19 is not limited thereto. For example, the tool engagement portion may have a Bi-Hex (deformed dodecagon) shape [ISO22977: 2005(E)] or the like.

(j) Although the spark plug 1 in the above-mentioned embodiments is mainly used for an engine, such as a gas engine under tough operating conditions, the technical idea of the present invention may be applied to a gasoline engine. In this case, improvement in anti-separation of the noble metal tip 33 and the increase in cost of forming the relieving layer tip 32 can be effectively prevented.

The invention claimed is:

1. A spark plug for use in an internal-combustion engine, comprising:

an insulator having an axial bore extending in an axial direction;

a rod-like center electrode disposed in the axial bore;

a cylindrical metal shell formed on an outer circumference of the insulator;

a ground electrode extending from a front end portion of the metal shell and bent towards the center electrode;

a plate-like relieving layer tip embedded in and joined to a front end portion of the ground electrode by resistance welding; and a noble metal tip having one end surface which is in contact with, and joined by resistance welding to, both a portion of the relieving layer tip on the center electrode side and to a portion of the ground electrode which corresponds to an outer circumference of the portion of the relieving layer tip on the center electrode side, and the noble metal tip further having the other end surface forming a gap with a front end portion of the center electrode, wherein the noble metal tip is made of a platinum alloy containing platinum as a principal component, wherein the relieving layer tip is made of a platinum alloy and has a linear expansion coefficient between that of the platinum alloy constituting the noble metal tip and a metal material constituting the ground electrode, wherein a portion of the relieving layer tip to which the noble metal tip is joined has an area smaller than an area of the one end surface of the noble metal tip, and wherein a melted bond formed by melting at least the noble metal tip and the ground electrode by laser welding is provided on an entire outer circumference of a boundary portion between the ground electrode and the noble metal tip.

2. The spark plug used for internal-combustion engines according to claim 1, wherein, the area of the portion of the relieving layer tip to which the noble metal tip is joined by resistance welding is 45% or more to 75% or less of the area of the one end surface of the noble metal tip.

3. The spark plug according to use for internal-combustion engines according to claim 1, wherein, the area of the portion of the relieving layer tip to which the noble metal tip is joined by resistance welding is 60% or more to 75% or less of the area of the one end surface of the noble metal tip.

4. The spark plug used for internal-combustion engines according to claim 1, wherein the relieving layer tip and the noble metal tip assume a disc-like shape, and wherein, an outer diameter of the portion of the relieving layer to which the noble metal tip is joined by resistance welding is 68% or more to 86% or less of an outer diameter of the one end surface of the noble metal tip.

5. The spark plug used for internal-combustion engines according to claim 1, wherein the relieving layer tip and the noble metal tip assume a disc-like shape, and wherein, the outer diameter of the portion of the relieving layer tip to which the noble metal tip is joined by resistance welding is 77% or more to 86% or less of the outer diameter of the one end surface of the noble metal tip.

6. The spark plug used for internal-combustion engines according to claim 1, wherein an area of the one end surface of the noble metal tip is 1.7 $mm^2$ or more.

7. The spark plug used for internal-combustion engines according to claim 1, wherein the noble metal tip is joined by melted bond to the ground electrode in a state that the one end surface thereof is embedded in the ground electrode, and wherein an embedding depth of the noble metal tip in the ground electrode is 25% or less of a height of the noble metal tip before being embedded.

8. The spark plug used for internal-combustion engines according to claim 1, wherein, in the melted portion, a platinum content is in the range of 9% to 25%.

9. The spark plug used for internal-combustion engines according to claim 8, wherein the melted portion satisfies the following relationship:

$$0.45<=B/A<=0.68,$$

where "A" (mm) is an outer diameter of an outermost portion of the melted portion in a radial direction, and where "B" (mm) is an inner diameter of an innermost portion of the melted portion in the radial direction.

10. The spark plug used for internal-combustion engines according to any one of claims 1 to 9, wherein the melted portion is comprised of a series of plurality of melting regions which are formed by irradiating a laser beam, and wherein a surface of each melting region overlaps with an adjoining melting region in a range between 20% or more to 60% or less of the adjoining melting region.

* * * * *